United States Patent [19]

Hoffman et al.

[11] Patent Number: 4,707,568

[45] Date of Patent: Nov. 17, 1987

[54] ARMORED POWER CABLE WITH EDGE SUPPORTS

[75] Inventors: Ernest G. Hoffman, Middlefield; David H. Neuroth, Hamden, both of Conn.

[73] Assignee: Hubbell Incorporated, Orange, Conn.

[21] Appl. No.: 866,290

[22] Filed: May 23, 1986

[51] Int. Cl.[4] ..... H01B 7/18

[52] U.S. Cl. ..... 174/103; 174/102 SP; 174/106 R; 174/109; 174/117 F

[58] Field of Search ..... 174/103, 102 SP, 106 R, 174/109, 102 SP, 47, 15 C, 117 F

[56] References Cited

U.S. PATENT DOCUMENTS

| | | | |
|---|---|---|---|
| 305,854 | 9/1884 | Shaw | 174/103 |
| 1,927,845 | 9/1933 | Pheazey | 174/104 |
| 3,404,217 | 10/1968 | Kelly | 174/103 |
| 4,374,530 | 2/1983 | Walling | 174/47 X |
| 4,409,431 | 10/1983 | Neuroth | 174/103 |
| 4,453,035 | 6/1984 | Neuroth | 174/103 |
| 4,453,036 | 6/1984 | Neuroth | 174/103 |
| 4,454,377 | 6/1984 | Neuroth | 174/103 |
| 4,454,378 | 6/1984 | Neuroth | 174/103 |
| 4,490,577 | 12/1984 | Neuroth | 174/103 |
| 4,532,374 | 7/1985 | Neuroth | 174/103 |
| 4,539,739 | 9/1985 | Himmelberger et al. | 29/564.1 |
| 4,567,320 | 1/1986 | Neuroth et al. | 174/103 |
| 4,572,926 | 2/1986 | Ganssle et al. | 174/103 |
| 4,609,416 | 9/1986 | Himmelberger et al. | 174/103 X |

FOREIGN PATENT DOCUMENTS 699558 11/1953 United Kingdom .

*Primary Examiner*—Morris H. Nimmo

*Attorney, Agent, or Firm*—Jerry M. Presson; Alfred N. Goodman; Mark S. Bicks

[57] ABSTRACT

An elongated, reinforced power cable for use in adverse environments. The cable is provided with internal structural members to resist crushing and other mechanical forces. The cable includes at least two power conductor assemblies which extend along the longitudinal axis of the cable. A protective metallic layer is provided for each conductor assembly and completely encases each conductor assembly. The conductor assemblies and protective metallic layers are aligned in a row within the cable, the row having a left end, a right end, a top plane and a bottom plane. A rigid support member is positioned at each end of the row of conductor assemblies. The support members have a height at least equal to the height of the protective layers to prevent compression of the protective layers and conductor assemblies. An armored covering is provided which fully encloses the support members, the protective layers and the conductor assemblies. The row has portions of the top and bottom planes which are not covered by a rigid support member. The protective metallic layers may have either a square cross section or a generally square cross section with chamfered edges.

21 Claims, 6 Drawing Figures

ARMORED POWER CABLE WITH EDGE SUPPORTS

FIELD OF THE INVENTION

This invention relates to power cable for use in extremely adverse environments, such as in oil wells. More particularly, this invention relates to such power cable having internal structural support members to prevent crushing of the cable.

BACKGROUND OF THE INVENTION

Certain uses of power cable (e.g., electrical, hydraulic, etc.) are in extremely adverse environments wherein the cable is subjected to extreme heat and large mechanical forces such as stress and crushing forces. One example of such an adverse environment is oil wells wherein a power cable runs from a surface power source down to equipment at the bottom of the oil well. Such oil wells can have depths of many thousands of feet. This cable is usually comprised of a plurality of conductor assemblies arranged in a single bundle. Each conductor assembly has a center conductive core element or filament surrounded by a layer of insulation.

This cable is commonly banded or otherwise affixed to the oil well tubing, commonly known as the "production tubing", which runs the depth of the well hole. These bands, straps, or other fastening members may crush the cable and thereby seriously degrade the effectiveness of the insulation of the cable and the strength of the cable. These cables are also subjected to impact damage during installation and retrieval of the production tubing, particularly when the cable is being employed in a deviated well hole, that is, a well which is not perfectly straight. For example, the cable may be crushed between the production tubing and the side of the well hole liner (commonly known as the "casing") as it is inserted or removed from the well hole.

In view of these adverse conditions, it has become conventional for cables that are to be employed in environments such as oil wells to be wrapped with an armor covering. In addition, the layers of insulation surrounding the individual conductors of the cable are selected for their optimum electrical, chemical and mechanical characteristics.

Often, these adverse environments also involve severe space limitations on the size of the cable which can be employed. This is particularly true of oil wells wherein the space between the production tubing and the casing and the size of the cable is critical. In view of these size limitations, it is advantageous to use a "flattened out" cable in these environments. A "flattened out" cable has two or more conductor assemblies forming a row. Typically, these cables involve three conductor assemblies arranged in a single row. While this design may overcome some of the problems with space limitations, the cable is still subjected to the possibly damaging mechanical forces discussed above.

To prevent the "flattened out" cable from being damaged by these mechanical forces, cable designs have been developed which have internal structural members located within the armor covering and between the individual conductor assemblies. Examples of these cables are disclosed in U.S. Pat. Nos. 4,409,431 issued to David H. Neuroth (a co-inventor of this invention) on Oct. 11, 1983; 4,453,035 issued to David H. Neuroth on June 5, 1984; 4,453,036 issued to David H. Neuroth on June 5, 1984; 4,454,377 issued to David H. Neuroth on June 12, 1984; 4,454,378 issued to David H. Neuroth on June 12, 1984; 4,490,577 issued to David H. Neuroth on Dec. 25, 1984; 4,532,374 issued to David H. Neuroth on July 30, 1985; 4,539,739 issued to John E. Himmelberger and James O. Scharf on Sept. 10, 1985; 4,572,926 issued to Robert Ganssle et al. on Feb. 25, 1986; and British Pat. No. 699,558 entitled "Improvements in or Relating to Electric Cables" and issued on Nov. 11, 1953.

While the cables disclosed in these patents have increased resistance to external mechanical crushing forces, additional problems have arisen because the numerous structural support members used have added additional weight and cost to the cable. In applications where great lengths of the cable are employed, such as in an oil well, this additional weight is a disadvantage as it adds to the weight of the production tubing and cable assembly which must be raised and lowered into the drill hole. This additional weight puts additional stress on the equipment used to transport the cable and to raise and lower the production tubing and cable and thus may slow the drilling operation. In addition, the use of numerous internal structural support members greatly adds to the material costs and manufacturing expenses for such highly reinforced cables.

Thus, there is a need in the art for a power cable for adverse environments which is resistant to external crushing forces such as the crushing forces of the banding operation which are present even in non-deviated holes, and yet is relatively lightweight and cost-effective. There is always a need in certain environments such as oil wells for a lightweight, strong and cost-effective power cable.

This invention fulfills these needs in the art, as well as other needs which become apparent to those skilled in the art once given this disclosure, by providing a power cable as disclosed herein.

SUMMARY OF THE INVENTION

Generally speaking, this invention provides an elongated, reinforced power cable comprising at least two power conductor assemblies extending substantially parallel along the longitudinal axis of the cable and at least two protective layers. Each conductor assembly is completely enclosed in one of the protective layers. The protective layers are arranged side-by-side and in direct contact forming a row having a left end, a right end, a top plane and a bottom plane. The right end of the row is formed by a right layer of the protective layers (and the conductor assembly enclosed therein), and the left end of the row is formed by a left layer of the protective layers (and the conductor assembly enclosed therein). The top and bottom planes have a center section which extends from the center of the left layer to the center of the right layer. The cable also includes a pair of rigid support members for resisting compressive forces directed transverse to the row of protective layers and an armor covering encasing the support members, the protective layers, and the conductor assemblies. One of the support members is located at each end of the row. The support members are located between the row ends and the armor covering but do not extend between the center sections of the top and bottom planes and the armor covering such that the armor covering is directly adjacent to the center sections of the top and bottom planes. The support members have a height at least equal to the height of the protective layers.

In some embodiments of this invention, the protective layers are convex polygons in facial contact. These polygons-may have parallel, interior planar surfaces which are in contact. The interior surface of the armor covering may contact the center sections of the top and bottom planes.

In certain other embodiments of this invention the protective layers have an approximately rectangular cross-section with a height and a width transverse to the longitudinal axis of the cable. The support members may be elongated channel members having a central web and a pair of flanges. The webs of the channels may abut the ends of the row and the flanges may abut the top and bottom planes.

In yet other embodiments of this invention, the protective layers may have a generally rectangular cross-section with chamfered edges such that the cross section includes top, bottom and two side faces forming the sides of the rectangle and four sloped edges which connect adjacent faces. In these embodiments the ends of the row have a straight vertical surface and a sloped surface at each end of the straight vertical surface. The support members may comprise a straight portion with two slanted flanges at each end of the straight portion. The straight portion of the support members abuts the straight vertical surface of the row ends and the flanges engage the sloped surfaces.

In further embodiments of this invention, the support members may be located only at the ends of the row and not extend between the top and bottom planes and the armor covering. The support members may be elongated flat plates with a height approximately equal to the height of the protective layers. These support members may be in abutment with the ends of the row.

The power cables according to this invention have many advantages over the prior power cables designed for the same applications. The cables according to this invention are relatively lightweight yet are still resistant to mechanical crushing forces transverse to the cable. Since the structural members are positioned only adjacent the ends of the row of conductors, this reduces the amount of structural material within the cable. Not only does this render the cable lighter in weight, it also lowers the material costs of the cable. Also since the cables only have structural members located at the ends of the row of the conductor assembly, these cables involve fewer parts. This also renders the cable easier to manufacture. However, even with this reduction in the amount of protective material, the cable is capable of withstanding all the commonly experienced mechanical abuse, stress, strain, etc.

Since the cable is lighter in weight, there is less wear and strain on the equipment employed in handling the cable. For example, when the cable is employed in oil wells, the force needed to raise and lower the cable is less.

Also, the internal cable assemblies are somewhat slidable with respect to each other. This limited flexibility may prevent or reduce damage to the cable if forces are applied transverse to the row of conductors.

Another advantage is that by locating the structural members on the outer ends of the row of conductors, mechanical protection is provided to the sides of the cable. This mechanical protection may resist damage during banding of the cable against another structural element (such as the production tubing) and during handling of the cable. In those embodiments of this invention wherein the metallic protective layers have a generally rectangular cross section, the flat sides distribute any compressive forces on the protective layers across the entire width of the protective layer. This provides greater area for stress distribution and thus reduces the per unit stress, the risk of cross-sectional rupture and deformation of the insulation.

Also, the embodiments of the invention wherein the protective layers have flat sides have the advantages over round protective layers of decreasing the contact stresses between (a) the individual protective layers, (b) the protective layers and the armor covering, and (c) the protective layers and the support members. Such stresses may deform the protective layers and lend to fatigue stress fracturing in the protective layers. Thus the reduction of these stresses reduces the risks of such stress fractures occurring.

BRIEF DESCRIPTION OF THE DRAWINGS

Certain embodiments of this invention are illustrated in the drawings submitted herewith, wherein.

DETAILED DESCRIPTION OF THE DRAWINGS

Figure 1:
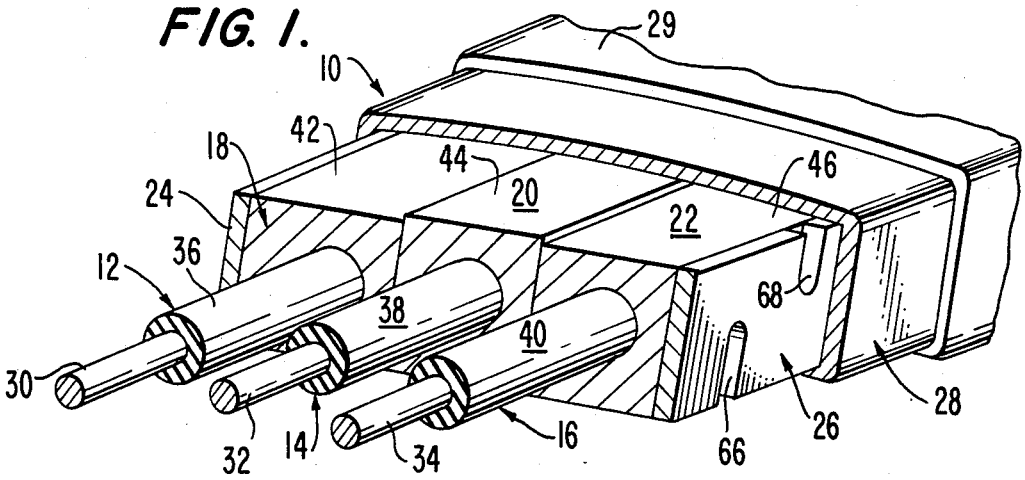
FIG. 1 is a perspective view of one embodiment of this invention wherein the support members are plates with rectangular cross sections.
Figure 2:
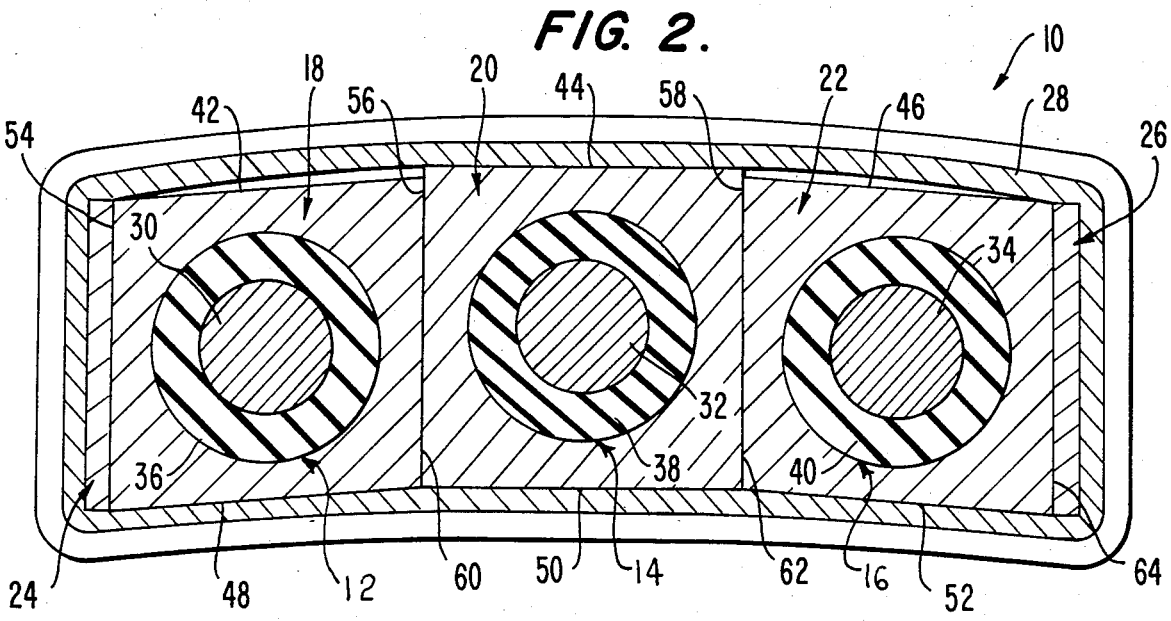
FIG. 2 is a transverse cross-sectional view of the embodiment of this invention illustrated in FIG. 1.

Referring to the Figures, in particular FIGS. 1 and 2, power cable 10 is illustrated including power conductor or conveying lines 12, 14 and 16, layers 18, 20 and 22 of metallic protective material, support members 24 and 26, and armor covering 28. Power cable 10 as illustrated is an electrical cable. However, cable 10 can be a hydraulic fluid conduit or any other type of power-carrying cable or conveying line.

Conductor assemblies 12, 14 and 16 are identical, and each includes a center conductive element or filament 30, 32 and 34 surrounded by insulation layers 36, 38 and 40, respectively. Such conductor assemblies are well known in the industry and thus are not described in detail herein.

The protective material which comprises layers 18, 20 and 22 is preferably metallic, and advantageously a lead sheathing. However, other suitable materials can be employed in place of the lead sheathing. Layers 18, 20 and 22 completely encase and enclose conductor assemblies 12, 14 and 16, respectively, to provide structural and other protection to the conductor assemblies. In the embodiment illustrated in FIGS. 1 and 2, layers 18, 20, and 22 have a substantially square cross section. In view of this shape, layers 18, 20 and 22 have top surfaces 42, 44 and 46, bottom surfaces 48, 50 and 52, left side surfaces 54, 56, and 58, and right side surfaces 60, 62 and 64, respectively.

Conductor assemblies 12, 14 and 16 and layers 18, 20 and 22 are arranged in a row as shown in FIG. 2. In this row, left side surface 54 of layer 18 forms the extreme left hand surface of the row, and right side surface 64 of layer 22 forms the extreme right surface of the row. Also, top surfaces 42, 44 and 46 form the top plane, and bottom surfaces 48, 50 and 52 form the bottom plane, of the row.

Support members 24 and 26 may be comprised of a sheet metal or other structural metal. In the embodiment illustrated in FIGS. 1 and 2, support members 24 and 26 are elongated, flat pieces of sheet metal extending the longitudinal length of cable 10.

Support member 24 is located on the left side of the row of conductor assemblies in abutment with left side surface 54 of layer 18. Support member 26 is located on the right side of the row of conductor assemblies in abutment with right side surface 64 of layer 22. The height of support members 24 and 26 is approximately equal to the height of protective layers 18, 20 and 22, but not less than the height of the protective layers to prevent crushing of the protective layers. Support members 24 and 26 do not extend above the top and bottom planes of the row of conductor assemblies and protective layers.

Spaced slots are provided in members 24 and 26 (see slots 66 and 68 in FIG. 1) so that members 24 and 26 can flex as cable 10 is bent during use. As is obvious from the Figures, structural members 24 and 26 provide protection to the edges of cable 10.

The use of structural members only at the edges of the row of conductor assemblies is one of the unique features of this invention. In the prior patents discussed above, the layers of protective material are completely encased by structural members. This unique feature results in the many advantages of this invention discussed above.

As shown in the Figures, conductor assemblies 12, 14 and 16, layers 18, 20 and 22 and members 24 and 26 are encased in armor covering 28. Such coverings are well known in the cable industry and include spaced interlocking ridges, such as ridge 29.

EMBODIMENT OF FIGS. 3–5

Figure 3:
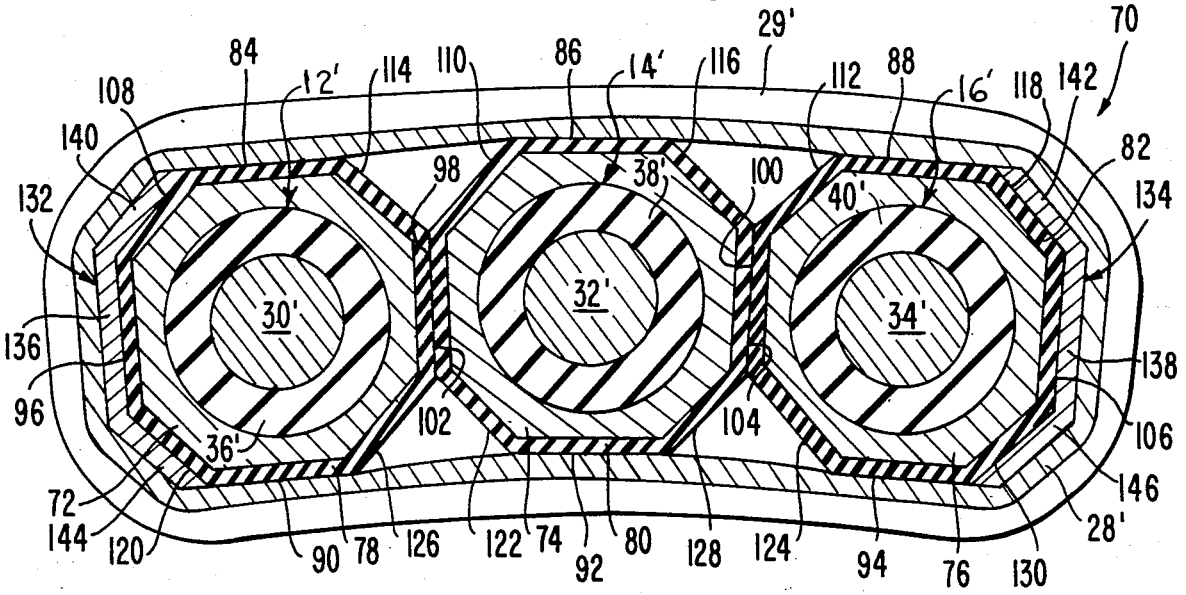
FIG. 3 is a cross-sectional view of a second embodiment of this invention wherein the support members form an open U-shape in cross section.
Figure 4:
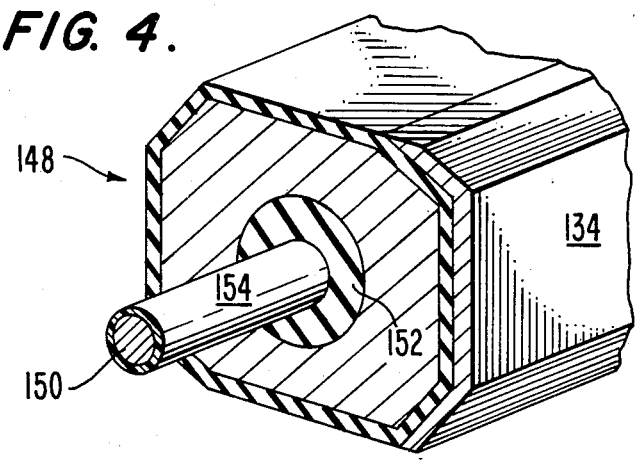
FIG. 4 is a perspective view of one embodiment of a conductor assembly and support member which can be located along the right side of the embodiment of this invention illustrated in FIG. 3.
Figure 5:
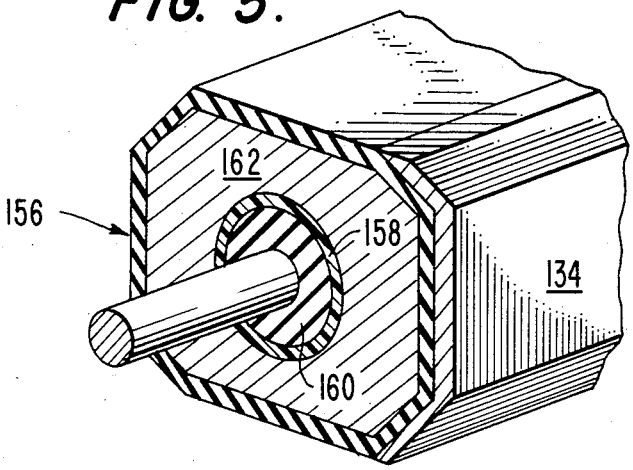
FIG. 5 is a perspective of a second conductor assembly and support member which can also be employed along the right side of the embodiment of this invention illustrated in FIG. 3.

A second embodiment of this invention, cable 70, is illustrated in FIGS. 3–5. Cable 70 includes conductor assemblies 12', 14' and 16' which are comprised of the same elements as cable 10, those being conductive elements 30', 32' and 34' and insulation layers 36', 38' and 40', respectively. In addition, conductor assemblies 12', 14' and 16' are surrounded by layers 72, 74 and 76 of protective material, respectively. Layers 72, 74 and 76 are comprised of the same material as layers 18, 20 and 22 but differ in that layers 72, 74 and 76 each have a generally square shape with chamfered edges, thereby forming a generally octagonal outer periphery. The result is an even greater material and weight reduction.

In the embodiment illustrated in FIG. 3, layers 78, 80 and 82 of bedding tape are applied around the exterior of layers of protective material 72, 74 and 76, respectively. Thus, in this embodiment, the protective layers for the conductor assemblies includes the layers of bedding tape and the layers of protective material. Because of the shape of layers 72, 74 and 76, the exterior of bedding tape layers 78, 80 and 82 from top surfaces 84, 86 and 88, bottom surfaces 90, 92 and 94, left side surfaces 96, 98 and 100, right side surfaces 102, 104 and 106, upper left sloped edges 108, 110 and 112, upper right sloped edges 114, 116 and 118, lower left sloped edges 120, 122 and 124, and lower right sloped edges 126, 128 and 130, respectively.

Cable assemblies 12', 14' and 16' are aligned in a row such that right side surface 102 of layer 78 is in contact with left side surface 98 of layer 80 and right side surface 104 is in contact with left side surface 100 of layer 88. Also, the extreme left side of the row is formed by left side surface 96, left top sloped edge 108 and left bottom sloped edge 120 of bedding tape 78. The extreme right side of the row is formed by right side surface 106, upper right sloped edge 118 and lower right sloped edge 130 of bedding tape 82.

Top surfaces 84, 86 and 88 form the top plane of the row of conductor assemblies and protective layers. Bottom surfaces 90, 92 and 94 form the bottom plane of the row of conductor assemblies and protective layers.

Cable 70 also includes support members 132 and 134 formed of sheet metal or other suitable material. Support members 132 and 134 have a generally open U-shape with straight side portions 136 and 138, upper slanted flanges 140 and 142 and lower slanted flanges 144 and 146, respectively. Support member 132 is positioned such that straight side portion 136 abuts left side surface 96, upper slanted flange 140 abuts upper left sloped edge 110 and lower slanted flange 144 abuts lower left sloped edge 120. Likewise, support member 134 is positioned such that straight side portion 138 abuts right side surface 106, slanted flange 142 abuts upper right sloped edge 108 and lower slanted flange 146 abuts lower right sloped edge 130.

The various conductor assemblies, bedding layers, protective layers and support members of cable 70 are then encased in an armor covering 28' having spaced ridges 29'.

The overall height of support members 132 and 134 is approximately equal to the combined height of the conductor assemblies, protective layers and bedding tape assemblies, but is of a height not less than the combined height of these items. This is of course desirable so that support members 132 and 134 resist crushing of cable 70. It is further noted that support members 132 and 134 are located at the ends of the row of conductor assemblies and do not extend over or undr the top and bottom planes of the row.

Other embodiments of individual conductor assemblies which can be employed in cable 10 are illustrated in FIGS. 4 and 5. The conductor assembly 148 disclosed in FIG. 4 is identical to conductor assemblies 12', 14' and 16' except that a layer of plastic 154 has been extruded between the conductive element 150 and the insulation layer 152.

In FIG. 5, conductor assembly 156 is the same as conductor assemblies 12', 14' and 16' except that a plastic layer 158 has been extruded between insulation layer 160 and layer 162 of protective metallic material.

Plastic layers 154 and 158 can be employed as desired to increase the insulation chemical resistance of the cable assembly. Also, bedding tape, such as bedding tape 78, 80 and 82 are optional and can be employed with the embodiment illustrated in FIGS. 1 and 2 or omitted from the embodiment illustrated in FIG. 3, as desired.

EMBODIMENT OF FIG. 6

Figure 6:
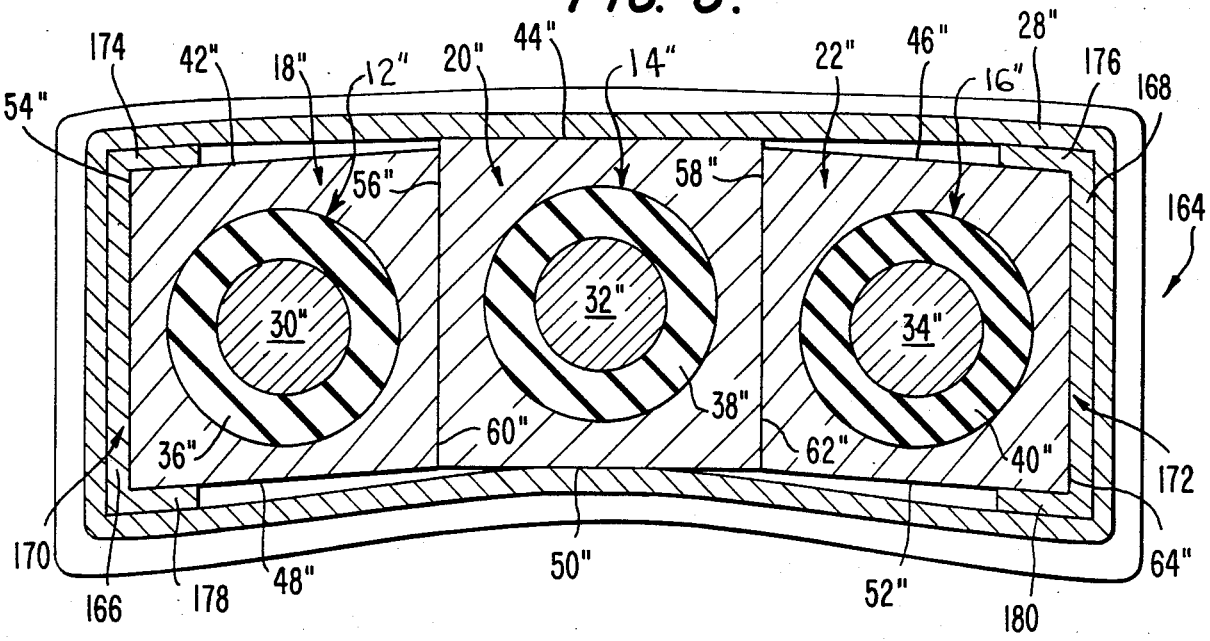
FIG. 6 is a cross-sectional view of a third embodiment of this invention wherein the support members have a U-shaped cross section.

FIG. 6 illustrates a third embodiment of this invention, cable 164. Cable 164 includes the same elements as cable 10, these being conductive elements 30'', 32'' and 34'', insulation layers 36'', 38'' and 40'', protective metallic layers 18'', 20'' and 22'' (having faces 42''–64'') and armor covering 28''.

Cable 164 also includes substantially U-shaped support members 166 and 168 positioned on each end of the row of conductor assemblies and protective metallic layers. Support members 166 and 168 are elongated channel members having central webs 170 and 172, and upper flanges 174 and 176 and lower flanges 178 and 180, extending respectively from the webs. Webs 170 and 172 are in abutment with faces 54'' and 64'', respectively. Upper flanges 174 and 176 abut and extend over upper faces 42'' and 46'', respectively, and lower flanges 178 and 180 abut and extend under lower faces 58'' and 52'', respectively.

Flanges 174 and 178 extend inward above and below protective metallic layer 18'' less than one-half the distance across protective metallic layer 18''. Likewise, flanges 176 and 180 extend inward above and below protective metallic layer 22'' less than one-half the distance across protective metallic layer 22''. This leaves center sections of the top and bottom planes of the row (extending between top flanges 174 and 176 and extending between bottom flanges 178 and 180) uncovered by a support member. Stated differently, support members 166 and 168 do not extend between these center sections and armor covering 28''.

Layers of bedding tape, similar to bedding tape 78–82, and layers of plastic, similar to layers 158 and 154, can be added to the embodiment illustrated in FIG. 6, as desired.

Once given this disclosure, many other embodiments, improvements and modifications of this invention will become apparent to those skilled in the art. Such other embodiments, modifications and improvements are within the scope of this invention as defined by the following claims:

What is claimed is:

1. An elongated, reinforced power cable, comprising:

at least two power conveying lines extending substantially parallel along the longitudinal axis of the cable;

at least right and left protective layers, each of said protective layers completely enclosing one of said power conveying lines, said layers being arranged side-by-side and in direct contract and forming a row having a left end, a right end, a top surface and a bottom, surface, the right protective layer forming the right end of the row and the left protective layer forming the left end of the row;

said top and bottom surfaces have a center section which extends from the center of the left layer to the center of the right layer;

a pair of rigid support members for resisting compressive forces directed transverse to the row of protective layers, one of said support members being located at each end of said row; and an armor covering enclosing said support members, said protective layers and said power conveying lines;

said support members being located between said row ends and said armor covering but not extending between said center sections of said top and bottom surfaces and said armor covering such that said armor covering is directly adjacent to said center sections of said top and bottom surfaces;

said support members having a height at least equal to the height of said protective layers.

2. A power cable according to claim 1 wherein said protective layers are convex polygons in facial contact.

3. A power cable according to claim 2 wherein said protective layers have parallel interior planar surfaces which are in contact.

4. A power cable according to claim 3 wherein said armor covering is continuous and has an interior surface, said interior surface contacting said center sections of said top and bottom surfaces.

5. A power cable according to claim 4 wherein said polygons are rectangles.

6. A power cable according to claim 4 wherein said polygons are octagons.

7. A power cable according to claim 1, wherein said protective layers have an approximately rectangular cross section with a height and a width transverse to the longitudinal axis of the cable;

said support members are elongated channels.

8. A power cable according to claim 7, wherein said support members each comprise a central web and a pair of flanges, the webs of said support members abut the ends of the row and the flanges of said support members abut said top and bottom surfaces of said row.

9. A power cable according to claim 1, wherein each of said protective layers has a generally rectangular cross section with chamfered edges such that said cross section includes top, bottom and two side faces and four slopee edges connecting said adjacent faces, said side faces of all of said protective layers are substantially parallel and opposing pairs of said side faces are in contact.

10. A power cable according to claim 5, wherein said ends of said row have a straight vertical surface and a sloped surface at each end of said straight vertical surface;

said support members have a straight portion which abuts the straight vertical surface of said ends and a slanted flange at each end of said straight portion which abuts the sloped surfaces fo said row ends.

11. A power cable according to claim 9, wherein each of said conveying lines includes a conductor surrounded by a layer of insulation;

the conveying lines also include a layer of plastic between the conductor and the insulation.

12. A power cable according to claim 9, and further comprising a layer of plastic material surrounding each of said conveying lines.

13. A power cable according to claim 1, wherein said support members do not extend between said top and bottom surfaces and said armor covering.

14. A power cable comprising:

at least two power conveying lines extending substantially parallel along the longitudinal axis of the cable;

at least two protective layers, each of said protective layers completely enclosing one of said power conveying lines, said layers being arranged side-by-side and in contact and forming a row having a left end, a right end, a top surface and a bottom surface;

a pair of rigid support members for resisting compressive forces directed transverse to the row of protective layers, one of said support members being located at each said end of said row; and an armor covering enclosing said support members, said protective layers and said power conveying lines;

said support members being located between said row ends and said armor covering but not extending between said top and bottom surfaces and said armor covering;

said armor covering being in contact with said top and bottom surfaces;

said support members having a height at least equal to the height of said protective layers.

15. A power cable according to claim 14, wherein said protective layers have an approximately rectangular cross section with a height and a width transverse to the longitudinal axis of the cable;

said support members are elongated flat plates with a height approximately equal to the height of the protective metallic layers.

16. A power cable according to claim 15, wherein said support members abut the ends of the row.

17. A power cable according to claim 14 wherein said protective layers are convex polygons having interior planar surfaces in facial contact.

18. A power cable according to claim 17 wherein said polygons are rectangles.

19. A power cable according to claim 17 wherein said polygons are octagons.

20. A power cable according to claim 14, wherein each of said protective layers has a generally rectangular cross section with chamfered edges such that said cross section includes top, bottom and two side faces and four sloped edges connecting said adjacent faces;

said side faces of all of said protective layers are substantially parallel and opposing pairs of said side faces are in contact;

said ends of said row have a straight vertical surface and a sloped surface at each end of said straight vertical surface;

said support members have a straight portion which abuts the straight vertical surface of said ends and a slanted flange at each end of said straight portion which abuts the sloped surfaces of said row ends.

21. A power cable having a height along an X axis, a width along a Y axis and a length along a Z axis, the combination comprising:

at least two insulated power conveying lines extending substantially parallel along the Z axis and spaced apart along the Y axis forming a row;

at least two protective layers, each of said layers completely enclosing one of said power conveying lines therein said layers being in direct contact with another of said protective layers;

a pair of rigid support members for resisting compressive forces directed at the cable along the X axis, said support members being located only at opposite ends of the row of power conveying lines on the Y axis; and an armor layer enclosing said support members, protective layers and power conveying lines therein;

said support members extending along the X axis a distance at least equal to the height of said protective layers along the X axis.

* * * * *